US010006448B2

(12) United States Patent
Smith

(10) Patent No.: US 10,006,448 B2
(45) Date of Patent: Jun. 26, 2018

(54) HYDRAULIC RAM LIQUID SUCTION PUMP APPARATUS AND METHODS

(75) Inventor: Thomas C. B. Smith, Begbroke (GB)

(73) Assignee: THERMOFLUIDICS LIMITED (GB)

( * ) Notice: Subject to any disclaimer, the term of this patent is extended or adjusted under 35 U.S.C. 154(b) by 625 days.

(21) Appl. No.: 13/876,282

(22) PCT Filed: Oct. 7, 2011

(86) PCT No.: PCT/GB2011/051934
§ 371 (c)(1),
(2), (4) Date: May 13, 2013

(87) PCT Pub. No.: WO2012/046080
PCT Pub. Date: Apr. 12, 2012

(65) Prior Publication Data

US 2013/0302182 A1 Nov. 14, 2013

(30) Foreign Application Priority Data

Oct. 8, 2010 (GB) ..... 1017000.9

(51) Int. Cl.
*F04B 9/107* (2006.01)
*F04F 1/08* (2006.01)
*F04F 7/02* (2006.01)

(52) U.S. Cl.
CPC ..... *F04B 9/107* (2013.01); *F04F 1/08* (2013.01); *F04F 7/02* (2013.01)

(58) Field of Classification Search
CPC ..... F04B 9/107; F04B 19/20; F04B 19/22; F04B 19/24; F04B 11/0008; F04B 23/02;
(Continued)

(56) References Cited

U.S. PATENT DOCUMENTS 1,005,417 A * 10/1911 Courtet ..... F04F 7/02 417/227
1,262,665 A * 4/1918 Hedges ..... F04F 1/10 417/122

(Continued)

FOREIGN PATENT DOCUMENTS

DE 621841 C 11/1935
DE 3118867 A1 12/1982

(Continued)

OTHER PUBLICATIONS

International Search Report for corresponding PCT/GB2011/051934, completed Apr. 19, 2012, by Christian Lange of the EPO.

(Continued)

*Primary Examiner* — Essama Omgba
*Assistant Examiner* — Stephen Mick
(74) *Attorney, Agent, or Firm* — Tarolli, Sundheim, Covell & Tummino LLP

(57) ABSTRACT

This invention relates to apparatus and methods for pumping liquids, in particular using hydraulic ram pump techniques. The techniques we describe can advantageously be used, for example, for drawing water from a deep well in a developing country. We describe a hydraulic ram liquid pump, the pump comprising: a liquid conduit having first and second arms and a connecting portion to connect said arms; first and second one-way inlet valves to said liquid conduit; first and second internal shockwave generating devices within said liquid conduit between said first and second inlets; at least one one-way exit valve from said liquid conduit; wherein, in use, when said second shockwave generating device is sealed a column of liquid in said first arm is in fluid communication with a said exit valve and when said first shockwave generating device is sealed a column of liquid in (Continued)

said second arm is in fluid communication with a said exit valve.

8 Claims, 9 Drawing Sheets

(58) Field of Classification Search
CPC ..... F04B 7/00; F04B 7/02; F04B 7/04; F04B 49/22; F04B 9/1073; F04F 7/02; F04F 7/04; F04F 7/06; F04F 7/08; F04F 7/16; F04F 7/18; F04F 7/20
USPC ..... 417/52, 92, 207, 101–103, 329
See application file for complete search history.

(56) References Cited

U.S. PATENT DOCUMENTS

| | | | | | |
|---|---|---|---|---|---|
| 1,409,476 | A * | 3/1922 | Smythe | F04F 1/10 | 417/125 |
| 1,859,394 | A * | 5/1932 | Holladay | F04F 7/02 | 417/260 |
| 3,907,462 | A | 9/1975 | Kroeger | | |
| 5,073,090 | A * | 12/1991 | Cassidy | F04F 1/10 | 417/102 |
| 2005/0022997 | A1 * | 2/2005 | Hardgrave | E21B 43/121 | 166/369 |
| 2005/0169776 | A1 * | 8/2005 | McNichol | F04B 9/107 | 417/390 |
| 2012/0114507 | A1 * | 5/2012 | Bouvier | F04F 3/00 | 417/148 |

FOREIGN PATENT DOCUMENTS

| | | | |
|---|---|---|---|
| EP | 0011286 | A1 | 5/1980 |
| FR | 416449 | A | 10/1910 |
| GB | 191225143 | | 12/1912 |
| SU | 1318731 | A | 6/1987 |

OTHER PUBLICATIONS

British Search Report for corresponding GB1017000.9, dated Sep. 8, 2011.

* cited by examiner

HYDRAULIC RAM LIQUID SUCTION PUMP APPARATUS AND METHODS

FIELD OF THE INVENTION

This invention relates to apparatus and methods for pumping liquids, in particular using hydraulic ram pump techniques. The techniques we describe can advantageously be used, for example, for drawing water from a deep well in a developing country.

BACKGROUND TO THE INVENTION

Broadly speaking a hydraulic ram pump converts some of the kinetic energy in a larger water flow rate into flow work at an increased static pressure in a smaller portion thereof by the Joukowski (water hammer) effect whereby repeated shockwaves are generated within the water flow by stopping the flow at intervals to create a form of water hammer. The shockwave(s) can be used to draw liquid into and expel liquid from the pump.

There is a problem in drawing water in particular from deep wells in developing countries where, say, electricity may not be readily available. The inventor has recognised that hydraulic ram pump techniques may be adapted to, inter alia, pressurize water at the bottom of a well.

SUMMARY OF THE INVENTION

In a first aspect the invention therefore provides a hydraulic ram liquid pump, the pump comprising: a liquid conduit having first and second arms and a connecting portion to connect said arms; first and second one-way inlet valves to said liquid conduit; first and second internal shockwave generating devices within said liquid conduit between said first and second inlets; at least one one-way exit valve from said liquid conduit; wherein, in use, when said second shockwave generating system is sealed a column of liquid in said first arm is in fluid communication with a said exit valve and when said first shockwave generating device is sealed a column of liquid in said second arm.

In preferred embodiments the liquid conduit has a U-bend. In one arrangement the liquid conduit is a U-tube liquid conduit providing the first and second arms; in another the liquid conduit comprises a region where the first and second arms define an arrangement of a pair of tubes, one within the other and preferably concentric. In this latter configuration the tubes are arranged to define a fluid pathway from around a lower end of the inner tube into the outer tube—a form of internal U-bend. In this concentric-tube embodiment the arms do not have to be concentric along their entire length—in some preferred embodiments they are only concentric at the lower portion of the apparatus, where they are conjoined.

Broadly speaking in embodiments each shockwave generating device generates a shockwave which propagates in two opposite directions through the U-tube conduit, in one direction as a wave of reduced pressure, in the other as a wave of increased pressure. The wave of reduced pressure operates to draw liquid, for example water, in through one of the inlet valves, and the wave of increased pressure operates to push the liquid, for example water, out of the at least one exit valve. The shockwave generating device may be open permitting a flow of liquid to pass through it, or sealed preventing any flow therethrough. The first and second shockwave generating devices operate alternately as the liquid in the U-tube oscillates back and forth, thus alternately drawing in liquid from each of the inlets and delivering water to the exit/outlet of the pump.

In embodiments the kinetic energy carried by the flow of liquid through each shockwave generating device prior to the closure thereof is stored in the increase in liquid level (and/or any other pressure storage means which may also be present at the ends of said arms where a driving force is applied, for example springs or gas springs) for use on the return stroke. Thus a further advantage of embodiments of the invention is that they enable kinetic energy lost through the shockwave generating device (or foot-valve), prior to its closure, to be recovered reactively.

In a well the connecting portion of the U-tube is located towards the bottom of the well, and this is preferably also where the first and second inlet valves are located. Thus the first arm of the U-tube is linked to the first inlet and the second arm to the second inlet. In embodiments a liquid path from the first arm encounters the first inlet before the second inlet, and vice versa. In embodiments, in operation, the liquid path from the first arm is always coupled to the first inlet valve, and vice versa. Although in some applications the U-tube is aligned vertically, for example in a well, in other applications the U-tube may be, say, coiled up on the ground, for example to pump water generally horizontally or uphill. Whatever the physical configuration of the U-tube, however, it is preferable that the connecting portion is approximately in a central region of the U-tubes between the two arms.

In some embodiments the shockwave generating devices may comprise flow-restrictor type valves, that is, valves which are configured to close in response to a mass or volume flow of liquid through the valve being greater than a threshold value. Thus, broadly speaking, in operation as the liquid oscillates back and forth within the U-tube the speed of the liquid will gradually increase in one direction until the flow-restrictor valve in that direction closes generating a shockwave, and in an alternate cycle will gradually increase in the opposite direction until the other flow-restrictor valve shuts, generating a second shockwave. In such an arrangement (or otherwise i.e. whether or not a buffer volume is incorporated into the exit line) it can be advantageous to have a pair of outlets from the U-tube coupled to a common liquid outlet for the pump, each of these being located between the shockwave generating devices, preferable each adjacent a said device.

In other embodiments the shockwave generating devices may comprise a pair of internal stops in combination with one or more sealing devices, for example a ball movable between the respective stops to provide a seal when located against a stop. In this type of arrangement the oscillating water flow moves the sealing device alternately into sealing engagement with one and then the other of the internal stops, at each sealing event generating a "water hammer" type shockwave to drive the pumping action.

In some embodiments a single exit valve is located between the pair of shockwave generating devices; in others a pair of outlets/exit valves is provided, one coupled to each arm, to either side of the shockwave generating devices (that is between a respective device and the distal end of the adjacent arm). In embodiments a pressure accumulator may be included in a fluid path between the exit valve and an outlet of the hydraulic ram pump. This may comprise a closed vessel containing a compressible fluid such as air as well as the pumped liquid, with the aim of dampening pressure oscillations, particularly where the pump outlet comprises a long coupling.

In embodiments the hydraulic ram pump is combined with a drive device to provide an oscillatory mechanical drive to the liquid in one or both of the arms of the U-tube. This may comprise, for example, a simple foot-operated treadle pump or, in some preferred embodiments, a heat engine. More particularly the heat engine may comprise a displacement pump or fluidic oscillator to drive the liquid in the hydraulic ram pump. We have previously described some particularly advantageous forms of such a heat engine in our previously filed patent application WO 2005/121539, hereby incorporated by reference in its entirety.

In a related aspect the invention provides a method of pumping a fluid, the method comprising: providing coupled first and second hydraulic ram pumps with a shockwave generating system and at least one exit valve, each having a respective internal seal to generate an internal shockwave in said fluid to both draw said fluid into a respective inlet and expel said fluid from said exit valve; oscillating said fluid within said coupled hydraulic ram pumps such that when said fluid is travelling in a first direction through said coupled pumps an internal seal of said first pump generates a shockwave to draw said fluid in through an inlet of said first pump and to expel said fluid through said exit valve whilst said internal seal of said second pump is open, and such that when said fluid is travelling in a second direction through said coupled pumps an internal seal of said second pump generates a shockwave to draw said fluid in through an inlet of said second pump and to expel said fluid through said exit valve whilst said internal seal of said first pump is open.

Broadly speaking, when the liquid is oscillating and moving in a first in direction the liquid "sees" a hydraulic ram pump operating to draw water in at the second inlet and expel water from the, or a common, shared exit, driven by a shockwave generated at the second shockwave generating device. When the liquid is moving in a second, opposite direction, the liquid "sees" a second hydraulic ram pump comprising the first shockwave generating device, and a first inlet, this pump operating to draw liquid in at the first inlet and expel liquid at a corresponding or the shared exit. Thus the device may in some respects be considered as a coupled pair of anti-phase hydraulic ram pumps with a shared set of components including a shared main liquid conduit of the pumps.

As previously described, embodiments of this technique may be employed to draw water from a well, potentially from a significant depth, for example of more than 100 meters. Alternatively the arrangement may be employed to provide a source of water at a pressure above atmospheric pressure, for example to pump water up a hill. Alternatively, embodiments of this technique may involve a combination of both drawing water from a well and providing a source of water at a pressure above atmospheric pressure, for example, when the level difference between the water table and the surface level is approximately equal to the level difference between the surface level and the discharge level. Applications of embodiments of the invention are, however, not limited to pumping water and may be employed for other liquids for example, including, but not limited to, oil.

A shockwave generating device may, in embodiments, comprise an end-stop and a bluff body, which may be a ball, shuttle or some other component to abut against the end stop. In a preferred embodiment, the material and wall thickness of the pipes used for the columns of liquid should be chosen such that the sound is conducted at a speed such that $\rho cv > P_d - P_h$ or $\rho cv > P_h - P_s$, where c is the modified sound speed, v is the velocity of the water in the arms when a shockwave generating device operates (for example a shuttle contacts either end-stop), $P_d$ is the pressure at which fluid is discharged through the discharge (exit) valve(s), $P_h$ is the hydrostatic pressure in the vicinity of the valves, and $P_s$ is the pressure at which fluid is induced through the suction (inlet) valves.

In a further related aspect the invention provides a fluid pump comprising: coupled first and second hydraulic ram pumps with a shockwave generating system and at least one exit valve, each having a respective internal seal to generate an internal shockwave in said fluid to both draw said fluid into a respective inlet and expel said fluid from said exit valve; and means for oscillating said fluid within said coupled hydraulic ram pumps such that when said fluid is travelling in a first direction through said coupled pumps an internal seal of said first pump generates a shockwave to draw said fluid in through an inlet of said first pump and to expel said fluid through said exit valve whilst said internal seal of said second pump is open, and such that when said fluid is travelling in a second direction through said coupled pumps an internal seal of said second pump generates a shockwave to draw said fluid in through an inlet of said second pump and to expel said fluid through said exit valve whilst said internal seal of said first pump is open.

In a still further related aspect the invention provides a liquid pump, for example a hydraulic ram water pump, the pump comprising: a liquid conduit, preferably a U-tube liquid conduit, having first and second arms and a connecting portion to connect said arms; a liquid pumping system at said connecting portion of said liquid conduit to draw liquid into said liquid conduit and pump liquid towards an outlet of said liquid pump; and a drive device to provide an oscillating mechanical drive to liquid in one or both of said first and second arms of said liquid conduit; wherein said drive device comprises a heat engine.

BRIEF DESCRIPTION OF THE DRAWINGS

These and other aspects of the invention will now be further described, by way of example only, with reference to the accompanying figures in which.

DETAILED DESCRIPTION OF PREFERRED EMBODIMENTS

Figure 1:
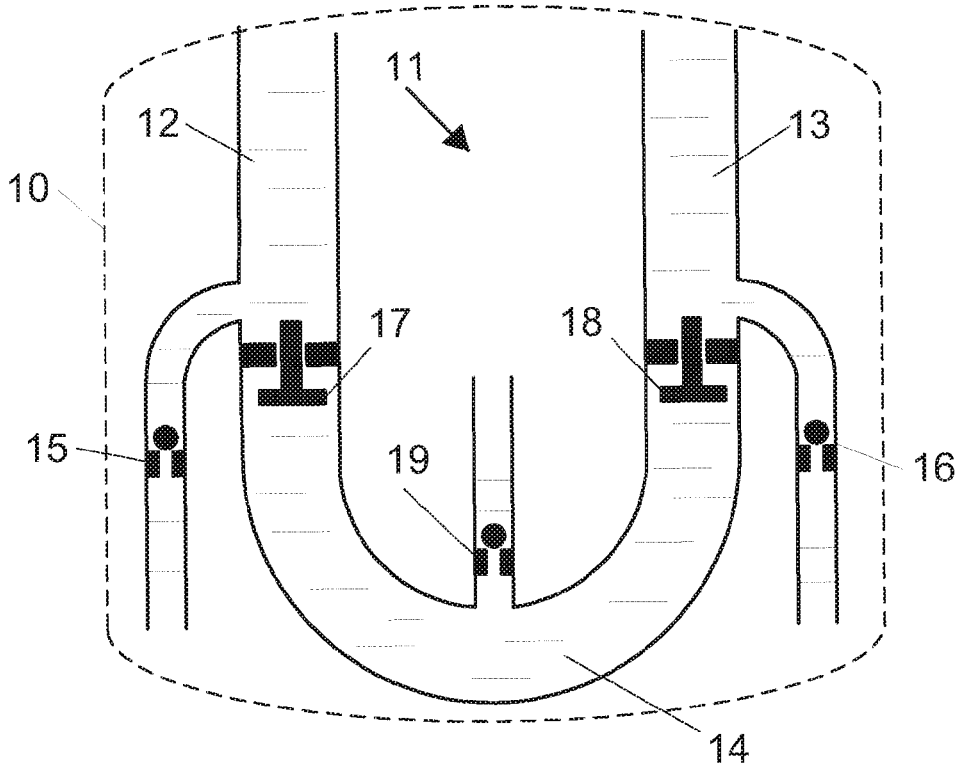
FIG. 1 shows a general embodiment of the invention.

Referring now to FIG. 1, this shows a hydraulic ram liquid pump [10], the pump comprising: a U-tube liquid conduit [11] having first and second arms [12,13] and a connecting portion [14] to connect said arms; first and second one-way inlet valves [15,16] to said U-tube; first and second internal shockwave generating devices [17,18] within said U-tube between said first and second inlets; and at least one one-way exit valve [19] from said U-tube. The shockwave generating device may be open permitting a flow of liquid to pass through it, or sealed preventing any flow therethrough. In use, when said second shockwave generating device [18] is sealed a column of liquid in said first arm [12] is in fluid communication with a said exit valve [19] and a column of liquid in said second arm [13] is in fluid communication with the second said inlet valve [16] whereas when said first shockwave generating device [17] is sealed a column of liquid in said second arm [13] is in fluid communication with a said exit valve [19] and a column of liquid in said first arm [12] is in fluid communication with the first said inlet valve [15].

Broadly speaking in embodiments there exist two acceleration phases of the operating cycle and two displacement phases thereof.

Figure 2:
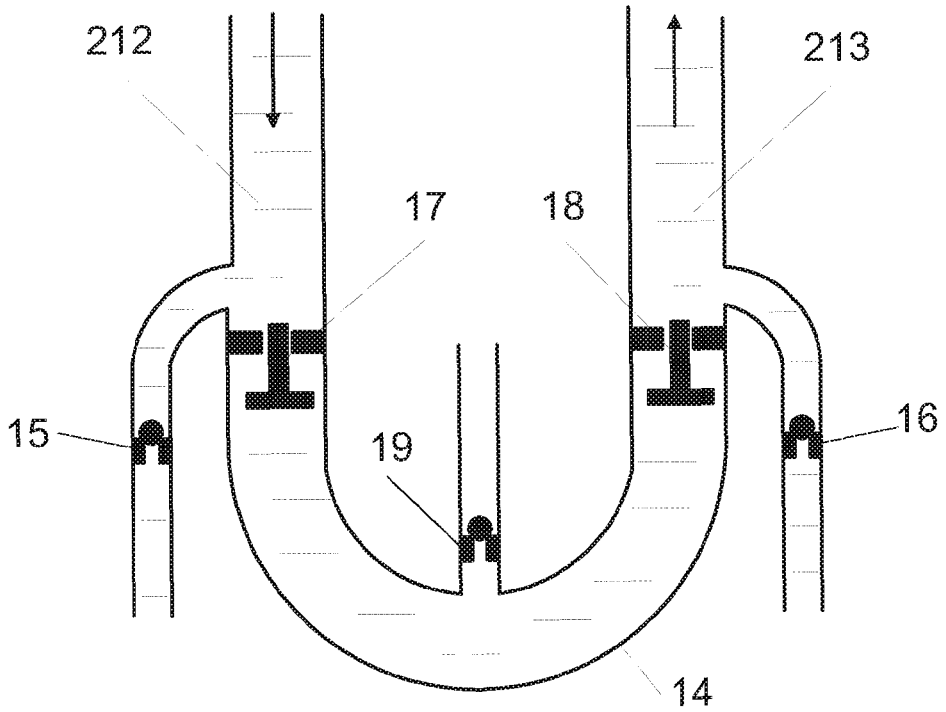
FIG. 2 shows the embodiment of the invention in FIG. 1 during an acceleration phase of the operating cycle

One of the said acceleration phases in which fluid is accelerated from the first said arm through said connecting portion to the second said arm is illustrated in FIG. 2.

Referring now to FIG. 2, during said acceleration phases, liquid accelerates downwards in said first arm [212] and upwards in said second arm [213] and said shockwave generating devices [17,18] remain substantially open and said one-way inlet valves [15,16] and the at least one exit valve [19] remain substantially closed.

Figure 3:
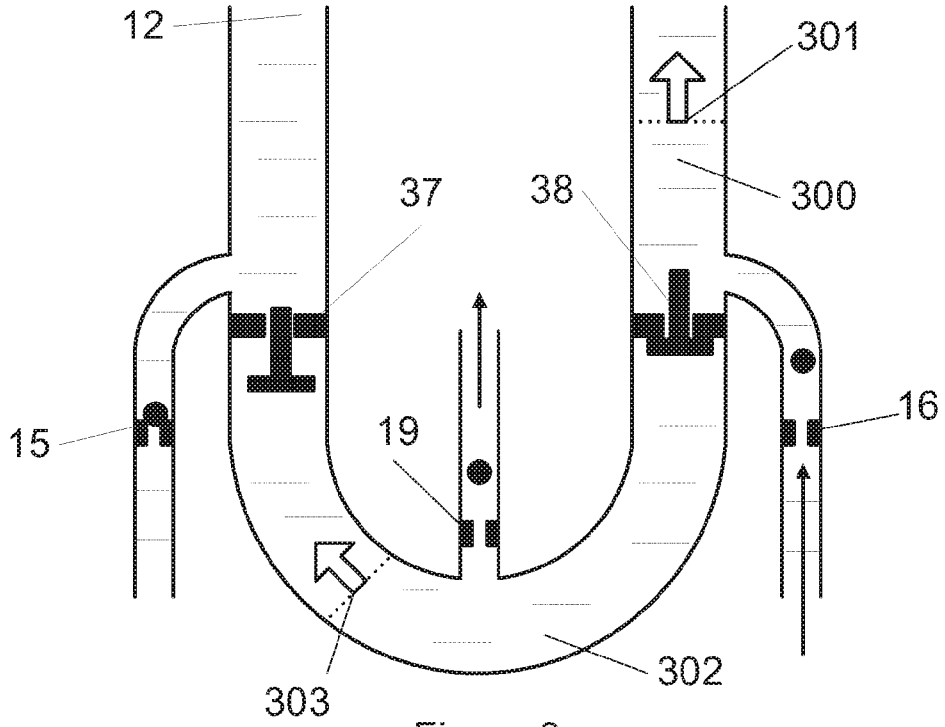
FIG. 3 shows the embodiment of FIG. 1 during a displacement phase of the operating cycle.

One of the said displacement phases in which fluid is displaced through said second one-way inlet valve [16] and through at least one said exit valve [19], is illustrated in FIG. 3.

Referring now to FIG. 3, each shockwave generating device [37, 38] generates a shockwave [301,303] which propagates in two opposite directions through the U-tube conduit, in one direction as a wave of reduced pressure [300], in the other as a wave of increased pressure [302]. The shock fronts may be reflected and reverberate one or more times and thereby travel in either direction at a given time. The wave of reduced pressure [300] operates to draw liquid, for example water, in through one of the inlet valves [16], and the wave of increased pressure [302] operates to push the liquid, for example water, out of the at least one exit valve [19]. The first and second shockwave generating devices operate alternately as the liquid in the U-tube oscillates back and forth, thus alternately drawing in liquid from each of the inlets and delivering water to the exit/outlet of the pump.

The kinetic energy carried by the flow of liquid through each shockwave generating device prior to the closure thereof is stored in the increase in liquid level (and any other pressure storage means as may also be present at the ends of said arms where a driving force is applied, for example springs or gas springs) for use on the return stroke.

In a well the connecting portion of the U-tube is located towards the bottom of the well, and this is preferably also where the first and second inlet valves are located. Thus the first arm of the U-tube is linked to the first inlet and the second arm to the second inlet. In embodiments a liquid path from the first arm encounters the first inlet before the second inlet, and vice versa. In embodiments, in operation, the liquid path from the first arm is always coupled to the first inlet valve, and vice versa. Although in some applications the U-tube may be aligned vertically, for example in a well, in other applications the U-tube may be, say, coiled up on the ground, for example to pump water generally horizontally or uphill. Whatever the physical configuration of the U-tube, however, it is preferable that the connecting portion is approximately in a central region of the U-tubes between the two arms.

Figure 4:
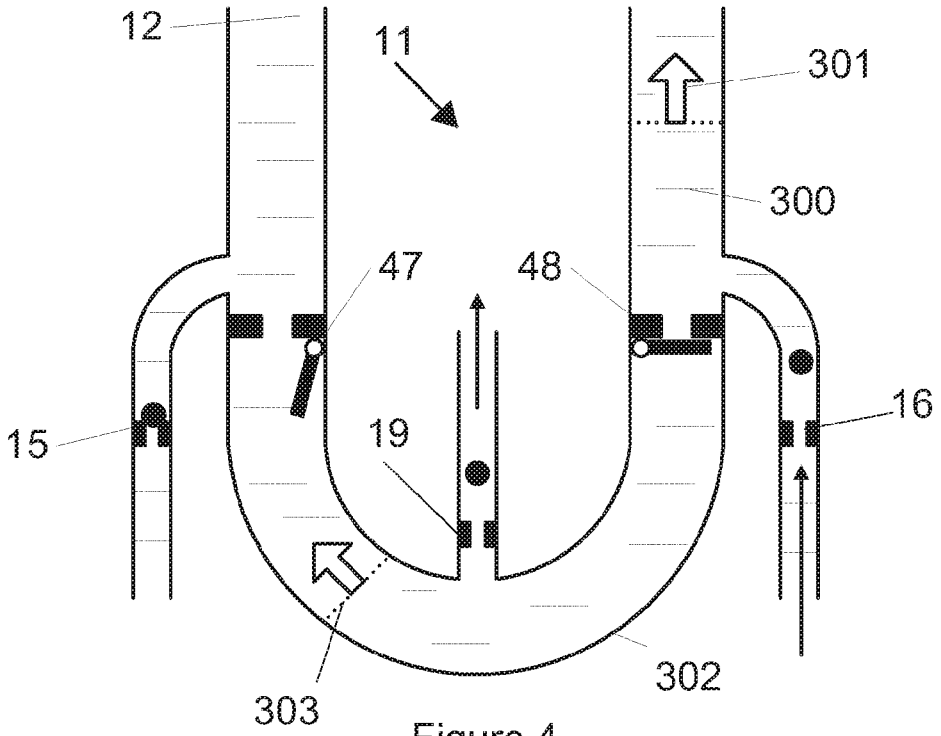
FIG. 4 shows an embodiment of the invention in which the shockwave generating devices are swing-check type valves or similar, during a displacement phase of the operating cycle.

In some embodiments the shockwave generating devices may comprise flow-restrictor type valves, that is valves which are configured to close in response to a mass or volume flow of liquid through the valve being greater than a threshold value, Referring to FIG. 4, an embodiment of the invention is shown in which the shockwave generating devices are swing-check valves [47, 48] aligned such that they are normally open and close only when a force due to an upward flow of liquid through them exceeds a force due to gravity acting to maintain them open. Thus, broadly speaking, in operation as the liquid oscillates back and forth within the U-tube there exist acceleration phases during which the speed of the liquid will gradually increase in one direction until the flow-restrictor valve in that direction closes thereby ending the acceleration phase and commencing a displacement phase wherein shockwaves are generated giving rise to a displacement of liquid through an inlet vale and the at least one exit valve and in an alternate cycle the speed of said liquid will gradually increase in the opposite direction until the other flow-restrictor valve shuts, generating a second set of shockwaves.

It is preferable that the at least one exit valve discharges into a buffer volume or reservoir that is close to both this and the shockwave generating devices. A long tube connected directly to the exit valve will impede performance. A buffer volume is desirable so that the inertia of liquid between the shockwave generating device and the outlet of the exit valve is minimised.

Figure 5:
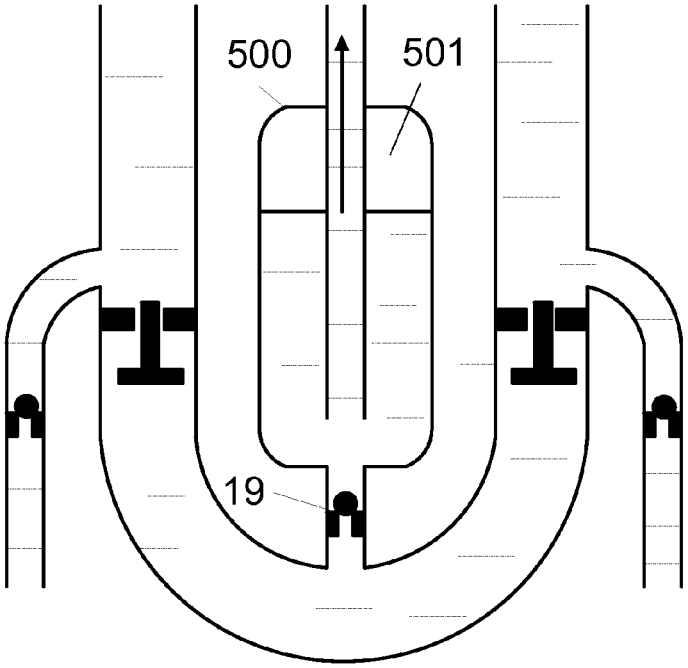
FIG. 5 shows an embodiment of the invention in which a buffer volume steadies the exit flow.

Referring now to FIG. 5, a buffer volume [500] is provided at the outlet of said exit valve [19] such that the mass of liquid therebetween is substantially minimised. The buffer volume may contain a gas such as air or otherwise or other compliance [501] with the intention that oscillations in the exit flow are buffered therein.

In such an arrangement or otherwise it can be advantageous to have a pair of outlets from the U-tube coupled to a common liquid outlet for the pump, each of these being located between the shockwave generating devices, preferable each adjacent to a said device.

Figure 6:
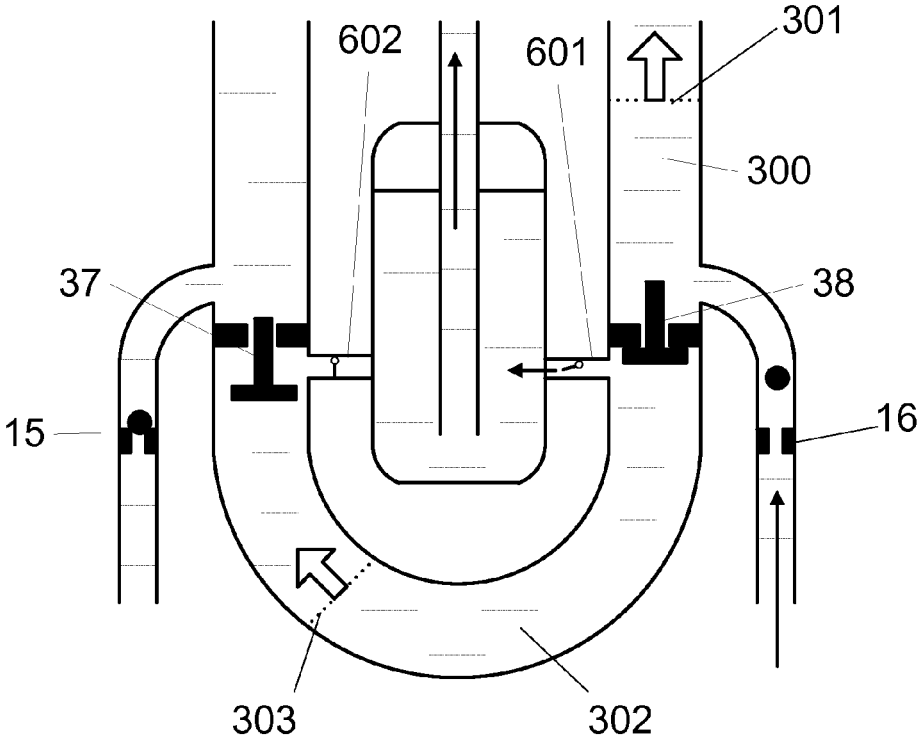
FIG. 6 shows an embodiment of the invention in which two exit valves are employed.

Referring now to FIG. 6, liquid is discharged through one said exit valve [601] during one of said displacement phases during which said second shockwave generating device [38] is sealed and liquid enters through said second inlet valve [16] whereas liquid us discharged through a second said exit valve [602] during a second said displacement phase during which said first shockwave generating device [37] is sealed and liquid enters through said first inlet valve [15].

In other embodiments the shockwave generating devices may comprise a pair of internal stops in combination with one or more sealing devices, for example a ball movable between the respective stops to provide a seal when located against a stop.

Figure 7:
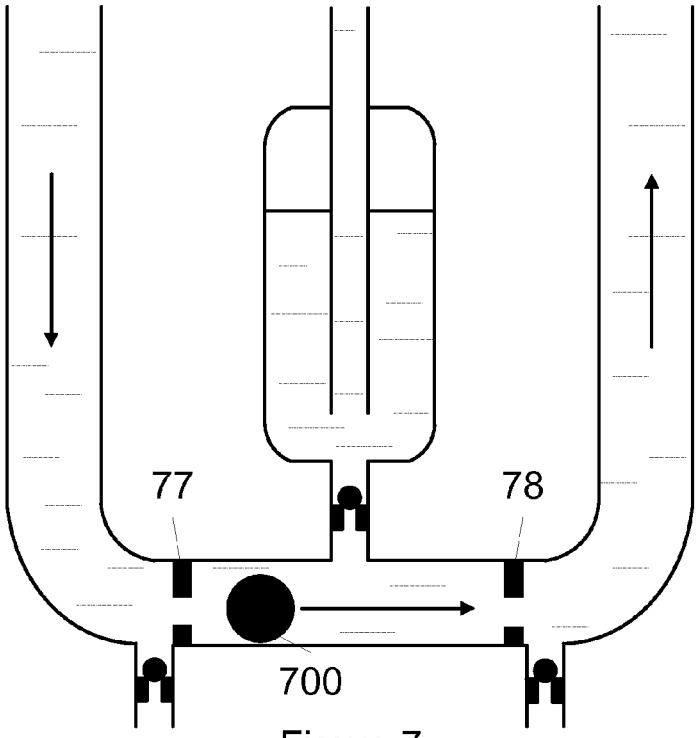
FIG. 7 shows an alternative embodiment of the invention, in which the shockwave generating devices are end-stops and a bluff body which may be a ball, shuttle or otherwise.
Figure 8:
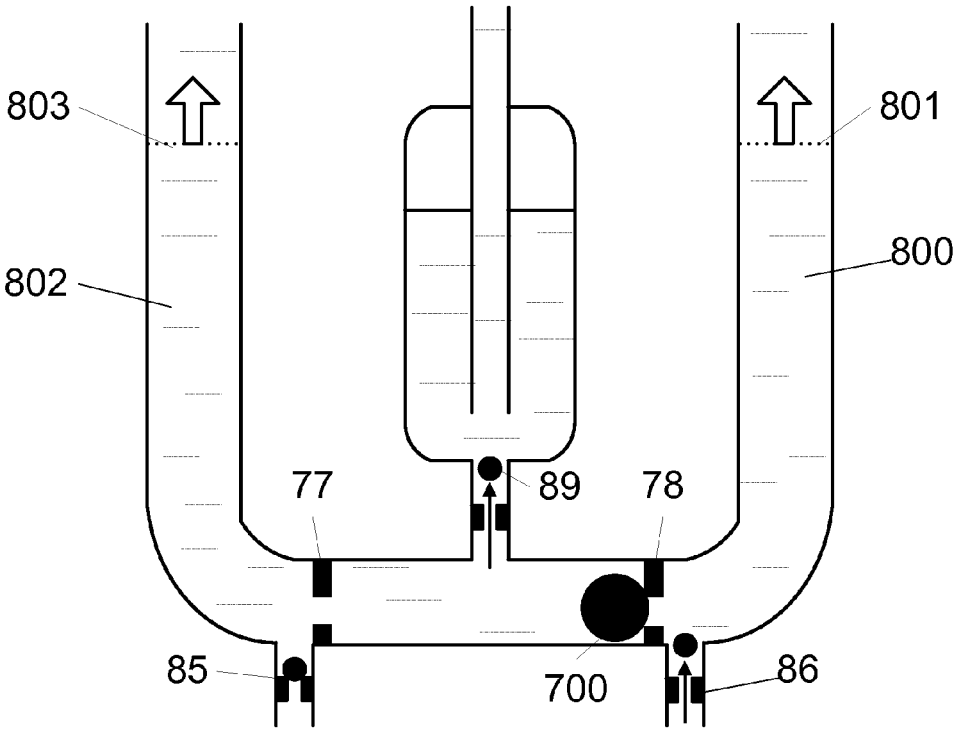
FIG. 8 shows an alternative embodiment of the invention, in which the shockwave generating devices are end-stops during a displacement phase of the operating cycle.

Referring now to FIG. 7, the oscillating water flow moves the sealing device [700] alternately into sealing engagement with one (e.g. [77]) and then the other (e.g. [78]) of the internal stops. FIG. 8 shows the same embodiment as shown in FIG. 7 during a displacement phase of the cycle wherein said sealing device [700] is in sealing engagement with one of the said internal stops [78] whereby shock waves [801, 803] propagate therefrom or thereto creating regions of low pressure [800] and high pressure [802] and one-way inlet valve [86] and at least one exit valve [89] open.

Figure 9A:
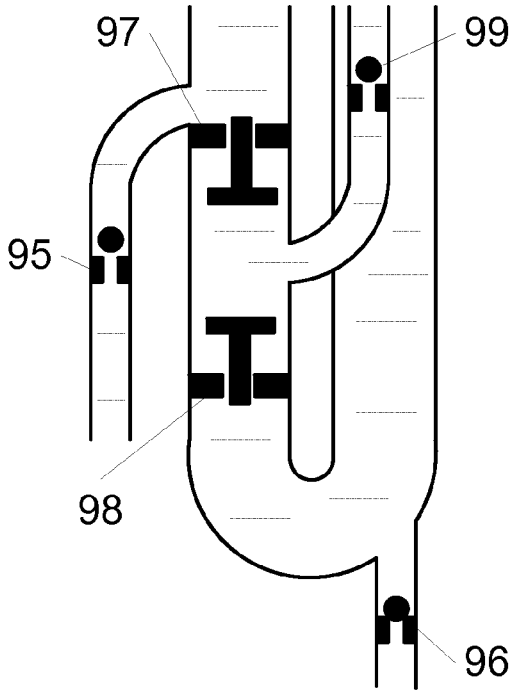
FIGS. 9*a* to 9*c* show, respectively an embodiment of the invention wherein the shockwave generating devices are located in one said arm to minimise the size of the pump; an embodiment of the invention, in which the shockwave generating devices comprise end-stops that are step increases or decreases in tube diameter; and an alternative embodiment of the invention comprising a concentric arrangement of the first and second arms.

In some embodiments such as borehole pumping, it is desirable to minimise the cross sectional area of the hydraulic ram pump perpendicular to the axes of the two arms. One means by which this may be achieved is shown in FIG. 9*a* wherein one shockwave generating device [97] is located substantially above a second shockwave generating device [98] and wherein one-way inlet valves [95, 96] and at least one exit valve [99] may be arranged such that liquid flows through them in approximately the same direction as adjacent liquid within the said arms with the intention that dynamic losses may be minimised.

Figure 9B:
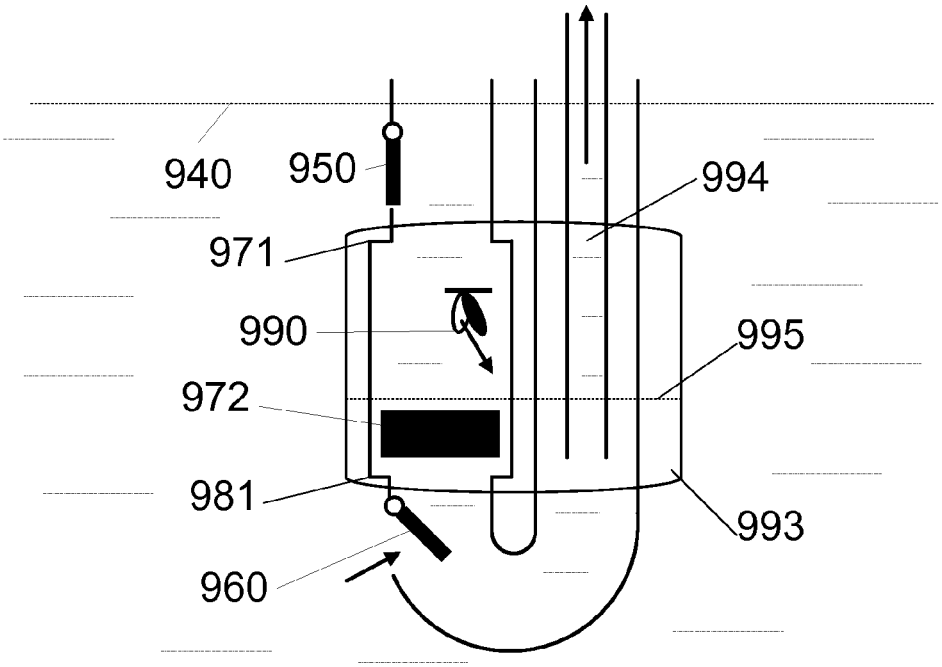

Referring now to FIG. 9*b*, an embodiment of the invention is shown during which the first arm contains a high pressure region behind the compression shockwave during the displacement phase and the second arm contains a low pressure region behind the expansion shockwave during the displacement phase. The shockwave generating devices comprise end-stops [971,981] and a sealing device or shuttle [972]. The end-stops are step increases or decreases in tube diameter. The extent of the step is determined by a trade-off between the area needed to seat the shuttle and generate a shock without damaging the shuttle or seating, and the turbulence and stagnation pressure loss incurred due to the step change in hydraulic diameter. The shuttle is made to be approximately neutrally buoyant in the pumped medium, either by making it from a dense material, but hollow and filled with air, or by making it solid and from a neutrally buoyant material. The shuttle and end-stops are both constructed from a material with sufficient shock/tear/cracking resistance, or incorporate protective plates attached to each face.

The inlet valves and at least one exit valve are arranged to comprise minimum inertia and to impose minimum pressure loss when liquid flows through them. This may be achieved by constructing them from a membrane over a hole, perforated plate or screen. The inlet valves are preferably arranged so that the top inlet valve [950] is close to the water surface [940] of the water outside the apparatus to be pumped (though not too close to risk uncontrolled intake of air). Both inlet valves [950,960] should be located close to the end-stops. The exit valve [990] may be arranged so that it discharges directly into an air-filled pressure accumulator or buffer volume [993]. The liquid level in the buffer volume [995] is set by a dip tube [994] and by the air pressure above the liquid contained therein. The liquid level in the buffer volume may be arranged so that the exit valve discharges directly into air, with the intention that the inertia behind it is minimised. However, this may be found to cause air to dissolve at a high rate, wherein it may be found preferable that the liquid level in the buffer volume is slightly above the exit valve. In either case, a snifting valve may be incorporated to replenish air dissolved from the buffer volume. Alternatively, means for drawing air in through the inlet valve and directing it to the exit valve, or membrane means to inhibit air present in the buffer volume from dissolving in the pumped water, may be employed.

The sound speed in the arms is also important, and consequently also the diameter of these tubes as well as the ratios of the hydraulic diameters of the various components in the system. This is because the sound speed in the arms is determined by:

1. The sound speed in the medium (e.g. water);
2. The elastic modulus of the material from which the arms are constructed;
3. The wall thickness of the arms.
4. The internal diameter of the arms.

The sound speed c in the arms should be greater than and preferably approximately equal to $$c = \frac{P_d - P_h}{\rho v} = \frac{P_h - P_s}{\rho v}$$

where $P_d$ is the pressure at which fluid is discharged through the discharge (exit) valve(s), $P_h$ is the hydrostatic pressure in the vicinity of the valves, $P_s$ is the pressure at which fluid is induced through the suction (inlet) valves, $\rho^\rho$ is the density of the pumped medium (e.g. water) and $v^v$ is the velocity of the water in the arms when the shuttle contacts either end-stop. For low pressures (up to 3 bar), and for given input power and displacement, the arms are preferably constructed from plastics and larger in diameter than for higher pressures; for they are preferably constructed from metals.

The hydraulic diameters should ideally be such that they change as little as possible from one component to the next. Preferably, diffusers are employed wherever a change in hydraulic diameter occurs.

Figure 9C:
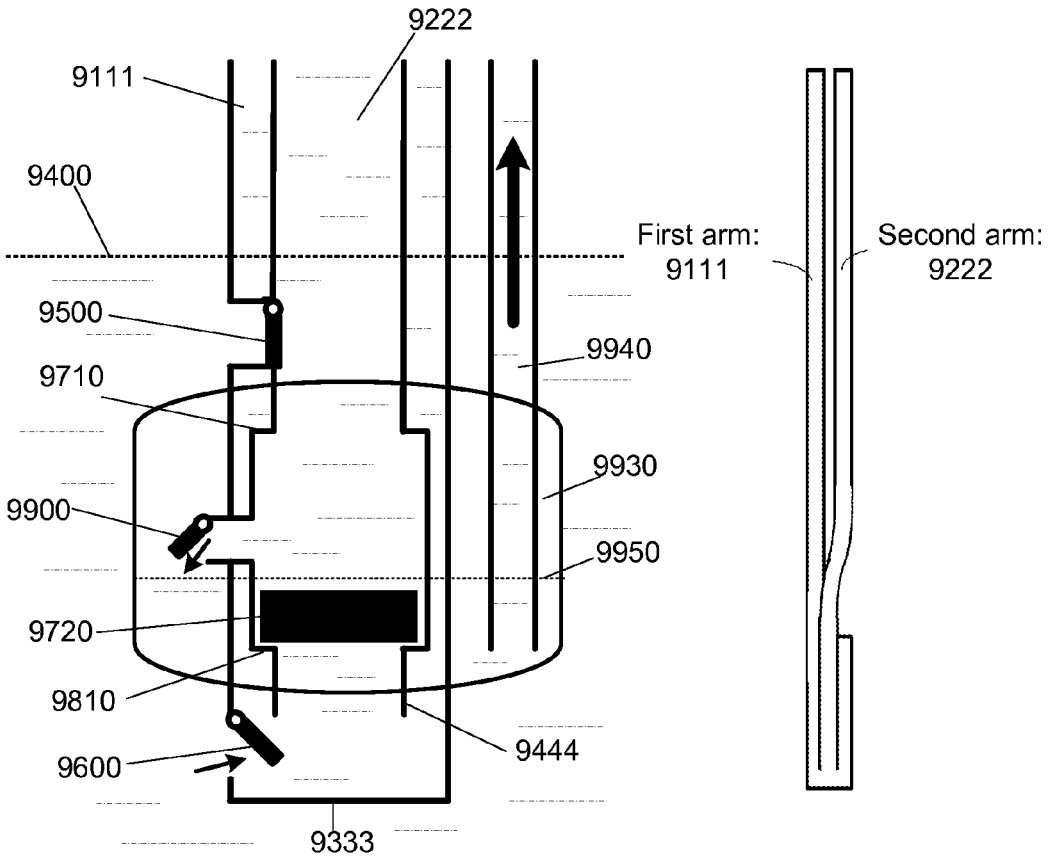

FIG. 9*c* shows how the arms may be arranged in an embodiment of the invention where the liquid conduit comprises a region where the first and second arms define a concentric arrangement of a pair of tubes. The image on the left shows an embodiment in which the first arm [9111] is arranged concentrically about the second arm [9222] such that the first arm forms an annular region surrounding the second arm. The first and second arms are joined at the bottom in an axisymmetric U bend arrangement by closing the bottom end [9333] of the first arm below the open bottom end [9444] of the second arm. In operation liquid oscillates up and down in the first and second arms displacing neutrally buoyant shuttle [9720] vertically up and down so that it impacts end stops [9710, 9810]. When the shuttle impacts upper end stop [9710] a compression shock propagates downwards and around the U bend into and up the first arm and an expansion shock propagates up the second arm. When the shuttle impacts the lower end stop [9810] a compression shock propagates up the second arm and an expansion shock propagates downwards and around the U bend into and up the first arm as shown in FIG. 9*c*. The resulting shockwaves cause inlet valves [9500, 9600] located below the surface of the water outside the apparatus to be pumped [9400] to open periodically causing water to be drawn in at approximately atmospheric pressure and exit valve [9900] to open and close periodically causing water to be expelled into buffer volume [9930] at high pressure in the same manner as other embodiments of the invention. The liquid level [9950] in the buffer volume is maintained by dip-tube [9940] whereby liquid is delivered to the intended application. Upper inlet valve [9500] and exit valve [9900] are located in spurs which pass through the walls of both arms [9111, 9222]. However, as shown in the image on the right, the arms do not necessarily have to be arranged concentrically along their entire length, but may be concentric only in the lower portion of the apparatus.

Figure 10:
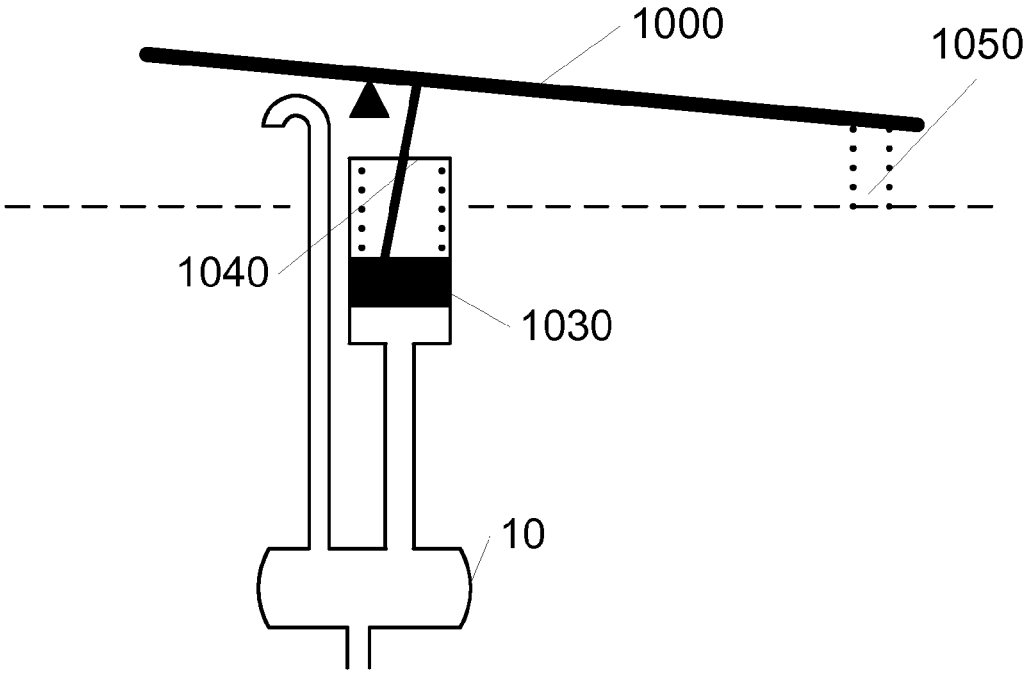
FIG. 10 shows an embodiment of the invention in which the invention is powered by a reciprocating heat engine of the type described in previously filed application WO 2005/121539 or otherwise.

In embodiments the hydraulic ram pump is combined with a drive device to provide an oscillatory mechanical drive to the liquid in one or both of the arms of the U-tube. Referring to FIG. 10, an embodiment is shown in which the mechanical drive to the hydraulic ram pump [10] is provided by a simple foot-operated treadle [1000] drive which may further comprise one or more drive pistons or diaphragms and drive cylinders [1030]. In such an embodiment or in other embodiments (such as the arrangement of FIG. 11 below) it may be desirable to incorporate springs (for example 1040, 1050), or a second buffer volume, to increase the resonant frequency of the oscillation.

Figure 11:
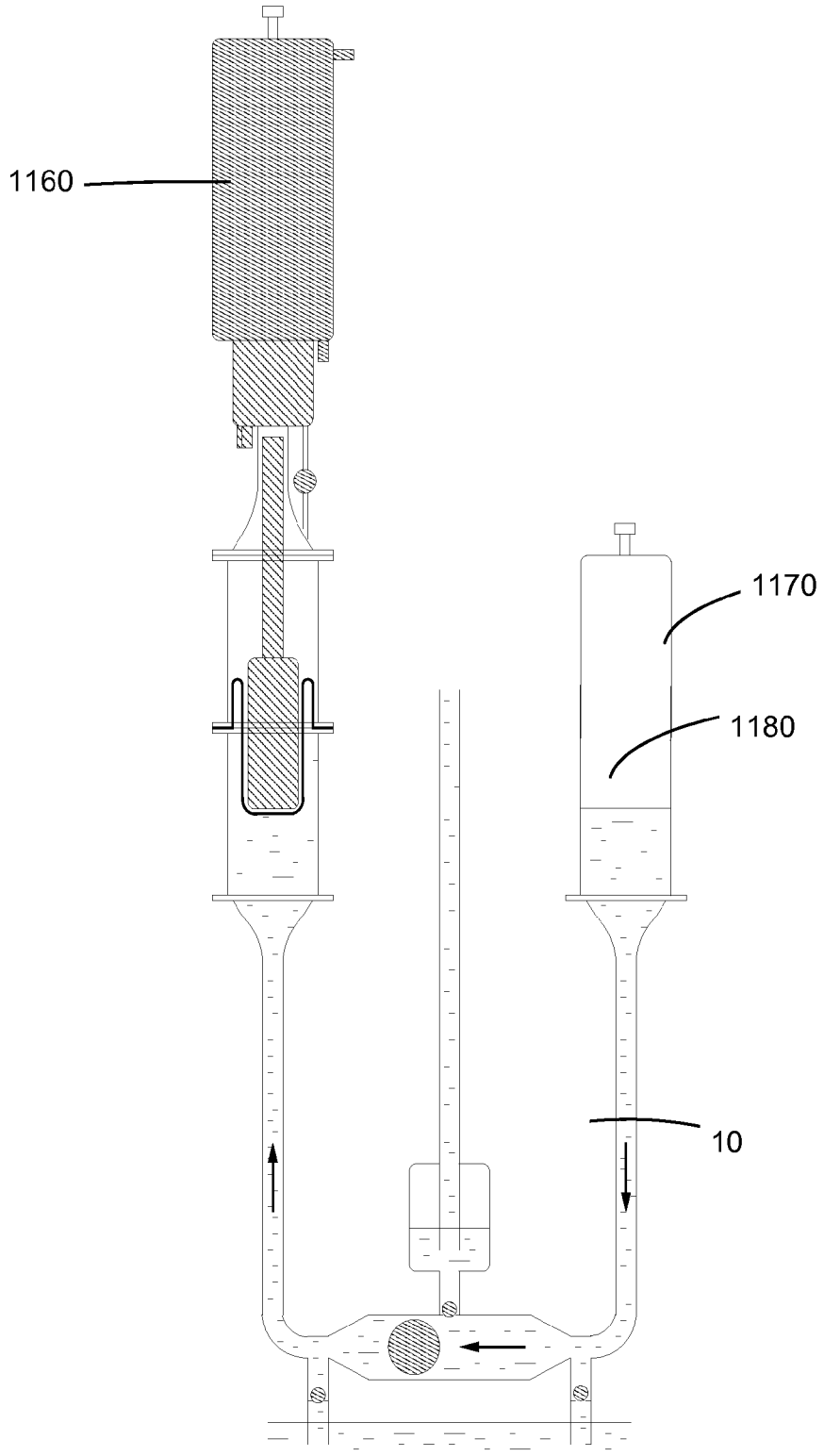
FIG. 11 shows an embodiment of the invention in which the invention is powered by two reciprocating heat engines operating in approximate antiphase.
Figure 12:
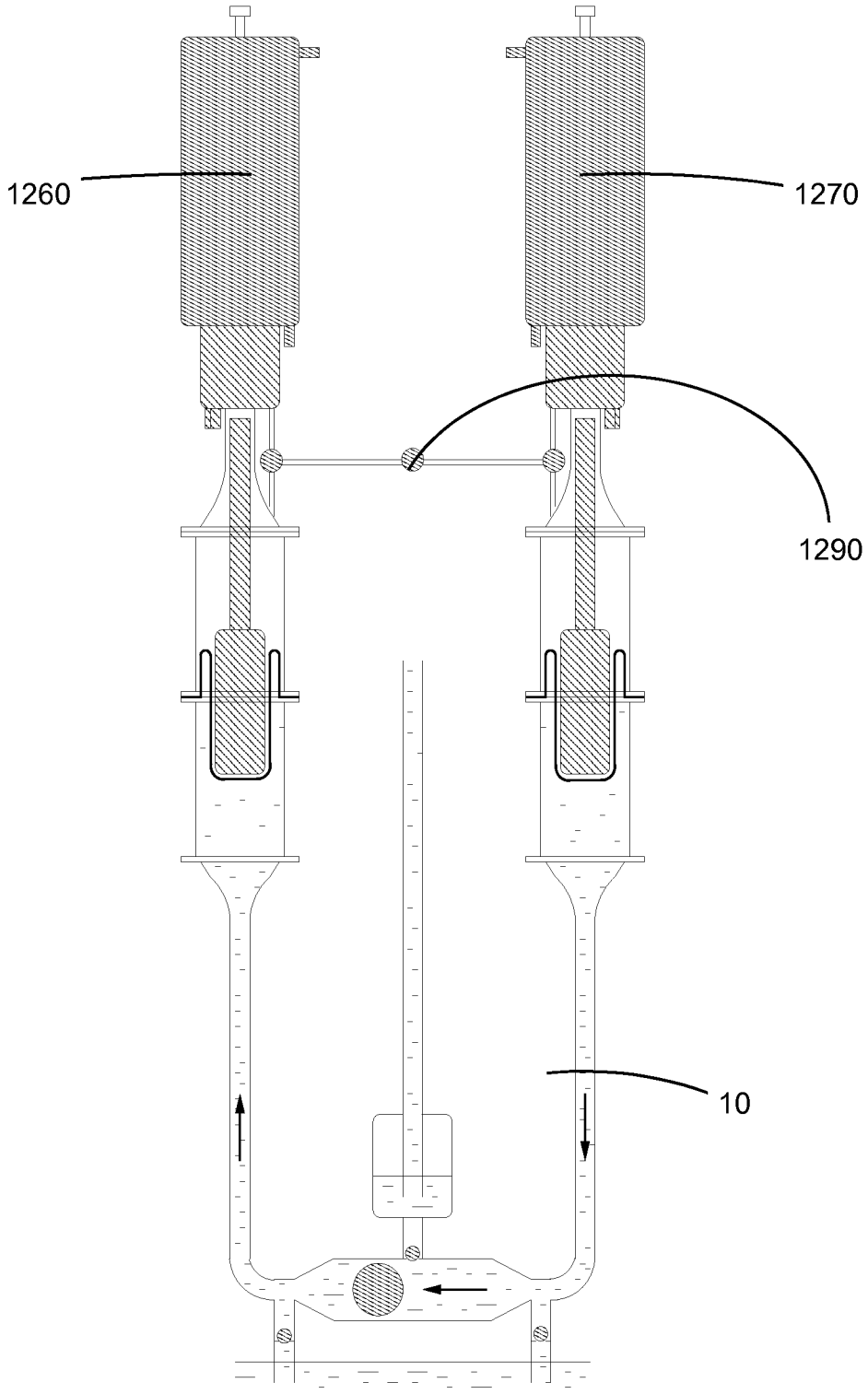
FIG. 12 shows an embodiment of the invention in which the invention is powered by human input, for example foot treadles or a handle.

In some preferred embodiments, the oscillation may be driven by a heat engine. Referring to FIG. 11, a hydraulic ram pump [10] may be driven by a heat engine [1160] that may comprise a displacement pump or fluidic oscillator to drive the liquid in the hydraulic ram pump. The heat engine may drive one arm of the U-tube and the other arm may be connected to a buffer volume [1170] containing a gas [1180] which may be air, to enable the resonance frequency of the oscillation to be tuned by varying the volume of air therein or otherwise. Referring to FIG. 12, a hydraulic ram pump may be driven by two heat engines [1260, 1270] one connected to each arm of the U-tube. The heat engines may be interconnected by a balancing capillary or valve [1290] so that they may operate efficiently in antiphase.

No doubt many other effective alternatives will occur to the skilled person. It will be understood that the invention is not limited to the described embodiments and encompasses modifications apparent to those skilled in the art lying within the scope of the claims appended hereto.

The invention claimed is:

1. A hydraulic ram liquid suction pump, the suction pump comprising:

a liquid conduit having first and second arms and a connecting portion to connect said arms;

first and second inlets to said liquid conduit having respective first and second valves, wherein said first and second valves comprise one-way inlet valves;

first and second internal shockwave generating devices within said liquid conduit between said first and second inlets;

at least one exit from said liquid conduit having at least one one-way exit valve;

wherein, in use, when said second shockwave generating device is sealed a column of liquid in said first arm is in fluid communication with said at least one one-way exit valve and when said first shockwave generating device is sealed a column of liquid in said second arm is in fluid communication with said at least one one-way exit valve;

wherein said first and second internal shockwave generating devices comprise third and fourth valves respectively, wherein said third and fourth valves are normally open such that liquid within said connecting portion is able to oscillate back and forth in use; and wherein said exit from said liquid conduit is located between said third and fourth valves;

wherein said first one-way inlet valve is located on an opposite side of said third valve to said exit, and wherein said second one-way inlet valve is located on an opposite side of said fourth valve to said exit, such that suction is created alternately at said first and second one-way inlet valves by respective waves of reduced pressure;

further comprising a drive device to provide an oscillating mechanical drive to an upper end of liquid in one or both of said first and second arms of said liquid conduit; and wherein said third and fourth valves are separated by a length of conduit including said exit from said liquid conduit and are configured such that a flow of said liquid in said length of conduit gradually increases in opposite directions during alternate cycles of oscillating flow driven by said oscillating mechanical drive before closing such that said third and fourth valves allow a flow in both directions through the length of conduit prior to reaching a threshold flow; and further comprising a pressure accumulator in a fluid path between said at least one one-way exit valve and an outlet of said hydraulic ram liquid pump.

2. A hydraulic ram liquid pump as claimed in claim 1 wherein a liquid path from said first arm is, in operation, always coupled to said first one-way inlet valve, and a liquid path from said second arm is, in operation, always coupled to said second one-way inlet valve.

3. A hydraulic ram liquid pump as claimed in claim 1 wherein said drive device comprises a heat engine.

4. A hydraulic ram liquid pump as claimed in claim 1 wherein said third and fourth valves respectively comprise first and second internal stops and a sealing device located within said liquid conduit and between said first and second internal stops and moveable between respective first and second sealing positions against said respective internal stops, such that when located against a respective said first or second stop the sealing device seals said liquid conduit internally against liquid pressure pushing towards said respective first or second stop.

5. A hydraulic ram liquid pump as claimed in claim 1 wherein said at least one exit valve is located between said first and second shockwave generating devices.

6. A hydraulic ram liquid pump as claimed in claim 1 comprising a pair of outlets from said liquid conduit each located between said first and second shockwave generating devices and adjacent a respective said shockwave generating device, and wherein said at least one exit valve is in fluid communication with said pair of outlets and is coupled to a common liquid outlet from said pump.

7. A hydraulic ram liquid pump as claimed in claim 1 wherein said liquid conduit is a U-tube liquid conduit.

8. A hydraulic ram liquid pump as claimed in claim 1 wherein said liquid conduit comprises a region where said first and second arms define an arrangement of a pair of tubes, one within the other, wherein said pair of tubes is arranged to define a fluid pathway from around an end of one of said tubes into the other said tube.

* * * * *